US012173251B2

(12) United States Patent
Kieckebusch et al.

(10) Patent No.: US 12,173,251 B2
(45) Date of Patent: Dec. 24, 2024

(54) TRANSMISSION FLUID

(71) Applicant: SHELL OIL COMPANY, Houston, TX (US)

(72) Inventors: Leonard Joachim Kieckebusch, Hamburg (DE); Christopher Claus Dobrowolski, Hamburg (DE)

(73) Assignee: Shell USA, INC., Houston, TX (US)

( * ) Notice: Subject to any disclaimer, the term of this patent is extended or adjusted under 35 U.S.C. 154(b) by 0 days.

(21) Appl. No.: 18/253,795

(22) PCT Filed: Dec. 16, 2021

(86) PCT No.: PCT/EP2021/086198
§ 371 (c)(1),
(2) Date: May 22, 2023

(87) PCT Pub. No.: WO2022/129334
PCT Pub. Date: Jun. 23, 2022

(65) Prior Publication Data

US 2024/0002744 A1 Jan. 4, 2024

(30) Foreign Application Priority Data

Dec. 17, 2020 (EP) ..... 20214986

(51) Int. Cl.
*C10M 169/04* (2006.01)
*C10M 105/34* (2006.01)
(Continued)

(52) U.S. Cl.
CPC ..... *C10M 169/044* (2013.01); *C10M 105/34* (2013.01); *C10M 105/42* (2013.01);
(Continued)

(58) Field of Classification Search
CPC ..... C10M 169/044; C10M 105/34; C10M 105/42; C10M 129/70; C10M 145/14;
(Continued)

(56) References Cited

U.S. PATENT DOCUMENTS

2020/0277542 A1 9/2020 Salvi et al.
2021/0122992 A1* 4/2021 Champagne ..... C10M 107/00
(Continued)

OTHER PUBLICATIONS

International Search Report and Written Opinion Received for PCT Patent Application No. PCT/EP2021/086198, Mailed on Feb. 4, 2022, 10 Pages.

*Primary Examiner* — Ellen M McAvoy
(74) *Attorney, Agent, or Firm* — Shell USA, Inc.

(57) ABSTRACT

Implementations of the disclosed subject matter provide a lubricating composition for use as a transmission fluid in an electric vehicle. The lubricating composition may include at least 70 wt %, based on the overall weight of the lubricating composition, of a biodegradable ester base oil with a kinematic viscosity at 100° C. in the range of 2.5 to 7.0 $mm^2/s$. The ester is biodegradable according to OECD test guidelines series 301. The composition may also include at least 0.5 wt % and no more than 10 wt %, based on the overall weight of the lubricating composition, of a viscosity index improver which is at least one high viscosity ester with a kinematic viscosity at 100° C. of at least 1000 $mm^2/s$; an anti-foam additive selected from silicone oil based antifoam additives and polyacrylate antifoam additives. Also disclosed is a process for lubricating an electric vehicle drive train comprising a transmission by applying the lubricating composition to the transmission.

9 Claims, 6 Drawing Sheets

O = comparative Example 2; + = Example 1; □ = Example 2

(51) Int. Cl.

| | |
|---|---|
| ***C10M 105/42*** | (2006.01) |
| ***C10M 129/70*** | (2006.01) |
| ***C10M 145/14*** | (2006.01) |
| ***C10M 155/02*** | (2006.01) |
| ***C10M 157/10*** | (2006.01) |
| ***C10M 161/00*** | (2006.01) |
| *C10N 20/00* | (2006.01) |
| *C10N 20/02* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 30/18* | (2006.01) |
| *C10N 40/00* | (2006.01) |
| *C10N 40/04* | (2006.01) |

(52) U.S. Cl.
CPC ..... *C10M 129/70* (2013.01); *C10M 145/14* (2013.01); *C10M 155/02* (2013.01); *C10M 157/10* (2013.01); *C10M 161/00* (2013.01); *C10M 2207/2815* (2013.01); *C10M 2207/301* (2013.01); *C10M 2209/084* (2013.01); *C10M 2229/02* (2013.01); *C10N 2020/02* (2013.01); *C10N 2020/081* (2020.05); *C10N 2030/02* (2013.01); *C10N 2030/04* (2013.01); *C10N 2030/06* (2013.01); *C10N 2030/10* (2013.01); *C10N 2030/18* (2013.01); *C10N 2040/04* (2013.01); *C10N 2040/40* (2020.05)

(58) Field of Classification Search
CPC C10M 155/02; C10M 157/10; C10M 161/00; C10M 2207/2815; C10M 2207/301; C10M 2209/084; C10M 2229/02; C10N 2020/02; C10N 2020/081; C10N 2030/02; C10N 2030/04; C10N 2030/06; C10N 2030/10; C10N 2030/18; C10N 2040/04
See application file for complete search history.

(56) References Cited

U.S. PATENT DOCUMENTS

| | | | | |
|---|---|---|---|---|
| 2021/0189283 | A1* | 6/2021 | Wang | C10M 157/10 |
| 2022/0131205 | A1* | 4/2022 | Champagne | H01M 10/36 |
| 2022/0333029 | A1* | 10/2022 | Scherer | C10M 105/36 |

* cited by examiner

O = comparative Example 2; + = Example 1; □ = Example 2

O = comparative Example 2; + = Example 1; □ = Example 2

◊ = comparative Example 2; Δ = Example 1; □ = Example 2

◊ = comparative Example 2; Δ = Example 1; □ = Example 2

TRANSMISSION FLUID

CROSS REFERENCE TO RELATED APPLICATIONS

This is a National stage application of International Application No. PCT/EP2021/086198, filed 16 Dec. 2021, which claims priority of European Application No. 20214986.0, filed 17 Dec. 2020 which is incorporated herein by reference in its entirety.

FIELD OF THE INVENTION

This invention relates to a lubricant fluid for use in a transmission application in an electric vehicle.

BACKGROUND OF THE INVENTION

E-mobility refers to vehicles powered, at least in part, by batteries, including fully battery powered electric vehicles and the complete range of hybrid vehicles (e.g. plug-in hybrids, series hybrids, etc.). The number of these vehicles on the road has increased rapidly in recent years and it is expected that the rate of take up of vehicles relying on some form of battery power will continue to increase considerably over the coming decades.

The growth of, at least partially, electric vehicles has led to increased demands for fluids suitable for use in the powertrain of such vehicles. There is less uniformity between different types of electric vehicle (EV) powertrains than there is in internal combustion engine (ICE) vehicles. In part, this is due to the degree of electrification of any vehicle, but also on the differences in design of the powertrain for vehicles with similar levels of electrification by different manufacturers. The design of fluids suitable for a range of e-mobility options contains many challenges.

Transmissions in pure battery-operated vehicles (BEVs) typically have a simple reduction gear set. Such vehicles have higher torques at low speeds and much higher rotational speeds than ICE powertrains. The absence of an internal combustion engine usually means that BEVs operate at lower temperatures than ICE vehicles. Creating fluids to perform effectively in these conditions is a challenge. Limitations on the range of additives useable in a lubricating fluid for the transmission of an electric vehicle may also be affected if the electric motor is integrated into the transmission.

Transmission Fluids vary in composition and performance aspects to meet the individual needs for each transmission concept. In most cases the general composition of a transmission fluid contains i) between 70 and 95% base oils; ii) between 3 and 15% of an additive package, containing various chemicals with functional effects, like antioxidants or detergent and anti-wear additives; iii) antifoaming additives, if not already part of the additive package; and iv) a viscosity modifier, usually a polymethacrylate, in the range of <1% up to 20%.

Historically, development of many fluids for ICE driven vehicles has been facilitated by testing in racing cars, which can provide excellent, closely monitored, test conditions for fluids designed to excel under extreme driving conditions.

Formula E is a single seater electric car-based motor racing world championship conceived in 2011 and having its inaugural season starting in 2014. As with other electric race car series, the electric drive unit (EDU) of the racing vehicles remains unchanged for the entire race season. Lubricant fluids in the vehicles may, however, be modified between races. Thus, the lubricant fluids used in Formula E, and other electric race car series, can be key differentiators between teams, as the properties and characteristics of the lubricant fluids can have a significant impact on the overall efficiency of a drivetrain.

An advantage of testing lubricant fluids in racing vehicles is that, due to the regular fluid changes, an individual fluid only needs to fulfil its function for a few hours. This is advantageous as the fluid can be formulated for extreme operating conditions and especially optimized for efficiency increase in the drivetrain without focusing on typical durability and thermal properties which need to be applied to transmission fluids for series applications on the market. Such optimizations made under these conditions can then be applied to the development of mainstream, long life, lubricant fluids.

It is clearly desirable to develop lubricant fluids with improved properties for use in electric vehicles, particularly those operating with high torques at low speeds; high speeds; and low temperature operating conditions.

SUMMARY OF THE INVENTION

Figure 1:
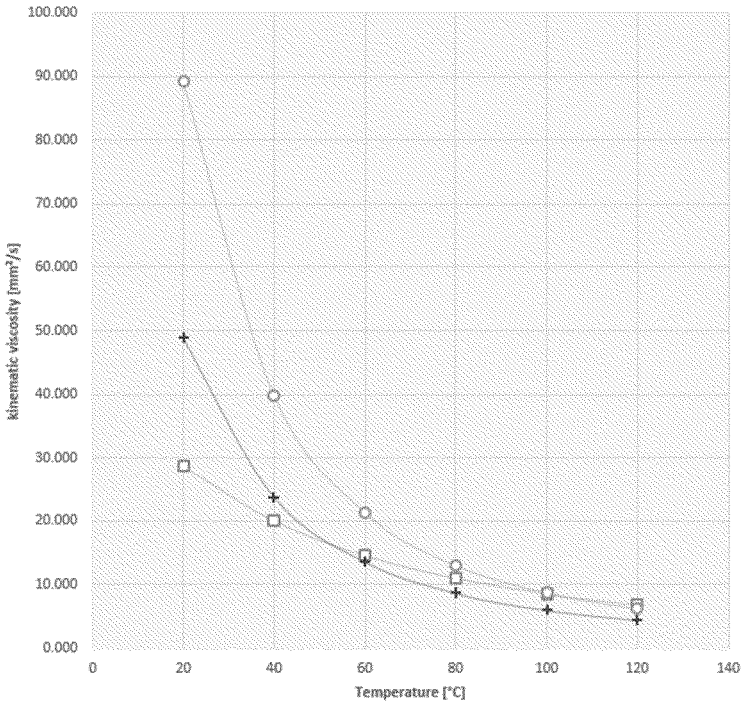
FIGS. 1 to 6 show the results of the Examples in the present application.

The present invention, therefore, provides a lubricating composition for use as a transmission fluid in an electric vehicle, said lubricating composition comprising:

(i) at least 70 wt %, based on the overall weight of the lubricating composition, of a biodegradable ester base oil with a kinematic viscosity at 100° C. in the range of from 2.5 to 7.0 $mm^2/s$, wherein the ester is biodegradable according to OECD test guidelines series 301;

(ii) at least 0.5 wt % and no more than 10 wt %, based on the overall weight of the lubricating composition, of a viscosity index improver which is at least one high viscosity ester with a kinematic viscosity at 100° C. of at least 1000 $mm^2/s$; and an anti-foam additive selected from silicone oil based antifoam additives and polyacrylate antifoam additives.

The present invention also provides a process for lubricating an electric vehicle drive train comprising a transmission, said process comprising the steps of applying to said transmission a lubricating composition, said lubricating composition comprising:

(i) at least 70 wt %, based on the overall weight of the lubricating composition, of a biodegradable ester base oil with a kinematic viscosity at 100° C. in the range of from 2.5 to 7.0 $mm^2/s$ wherein the ester is biodegradable according to OECD test guidelines series 301;

(ii) at least 0.5 wt % and no more than 10 wt %, based on the overall weight of the lubricating composition, of a viscosity index improver which is at least one high viscosity ester with a kinematic viscosity at 100° C. of at least 1000 $mm^2/s$; and (iii) an anti-foam additive selected from silicone oil based antifoam additives and polyacrylate antifoam additives.

DETAILED DESCRIPTION OF THE INVENTION

The present inventors have surprisingly found that ester components as base oils in electric vehicles may be used in combination with high viscosity esters and anti-foams selected from silicone oil based anti-foams and polymethacrylate anti-foams and provide transmission fluids with excellent properties.

According to API classification, ester base oils are classified in Group V. The ester base oils have been shown to build up better lubrication layers on metal surfaces and reduce friction within a gearbox more effectively compared to mineral base oils. The high polarity of ester-based base oil leads to excellent cleaning properties during each oil drain. The increased thermal conductivities of the ester base oils provide improved cooling properties compared to typical transmission fluid base oils, such as those in API Group III or Group IV. The lubricant formulations of the invention can also improve friction characteristics, providing higher efficiency as less heat is produced.

The lubricating composition of the invention comprises at least 70 wt %, based on the overall weight of the lubricating composition of a biodegradable ester base oil.

The biodegradable ester base oil may be a single type of ester base oil or may be a blend of one or more ester base oils. Suitable biodegradable ester base oils or blends thereof that can be used preferably have a kinematic viscosity at 100° C. of from 2.5 to 7.0 $mm^2/s$, and preferably not less than 4 $mm^2/s$ and not more than 6 $mm^2/s$.

In a preferred embodiment, the biodegradable ester base oil is made up of a mixture of two ester base oils. For example, in one particularly preferred embodiment, the biodegradable ester base oil may be formed from the combination of a first biodegradable ester base oil with a kinematic viscosity at 100° C. in the range of from 4 to 6 $mm^2/s$, for example 5 $mm^2/s$, and a second biodegradable ester base oil with a kinematic viscosity at 100° C. in the range of from 2.5 to 3 $mm^2/s$, for example 2.8 $mm^2/s$.

In this preferred embodiment, the first biodegradable ester base oil is preferably present in an amount in the range of from 15 to 30 wt % based on the overall lubricating composition and the second biodegradable ester base oil is preferably present in an amount in the range of from 50 to 70 wt % based on the overall lubricating composition.

The biodegradable ester base oil or mixture thereof is present in a total amount of at least 70 wt %, preferably at least 75 wt %, more preferably at least 80 wt %, based on the overall weight of the lubricating composition.

The biodegradable esters as referred to herein are esters that are considered to be biodegradable according to OECD test guidelines series 301.

As well as the biodegradable ester base oils the lubricating composition comprises no more than 10 wt %, preferably no more than 8 wt % and more preferably no more than 6 wt % of a viscosity index improver which is at least one high viscosity ester. Said viscosity index improver is present in an amount of at least 0.5 wt %, preferably at least 3 wt %, based on the overall weight of the lubricating composition.

Suitably, the viscosity index improver is added in amount such that the viscosity index of the overall lubricating composition is greater than 190.

Suitable high viscosity esters include those with a kinematic viscosity at 100° C. of at least 1000 $mm^2/s$, preferably at least 1500 $mm^2/s$. Also suitable, said high viscosity esters have a kinematic viscosity at 40° C. of at least 30,000 $mm^2/s$ and a flashpoint (measured according to ASTM D92) of at least 275° C.

The lubricating composition of the present invention also comprises an anti-foam additive. Said anti-foam additive is selected from silicone oil based anti-foam additives and polymethacrylate anti-foam additives. Suitable silicone oil based anti-foam additives include Preferably, if the anti-foam additive comprises one or more silicone oil based anti-foam additive, said silicone oil based anti-foam additives are present in an amount of no more than 0.1 wt %. More preferably, if present, the silicone oil based anti-foam additives are present in an amount such that the silicon content of the overall lubricating composition is in the range of from 2 to 15, even more preferably from 3 to 12 ppmw.

Preferably, if the anti-foam additive comprises one or more polyacrylate anti-foam additive, said polyacrylate anti-foam additives are present in an amount of no more than 0.1 wt %. Any polyacrylate, including poly(alkyl)acrylates, known as anti-foam additives may be suitable for use in the lubricating composition of the present invention.

To be compatible with electric motors, a lubricating composition needs to have low conductivity in order to insulate high voltage components from each other and prevent dielectric breakdowns. Therefore, the lubricating composition of the present invention preferably has a specific electrical resistivity according to DIN EN 60247 of more than 60 MOhm*m at 20° C. and more than 6 MOhm*m at 100° C.

Suitably, the lubricating composition of the present invention also comprises a performance additive package. A typical performance additive package comprises a mixture of extreme pressure anti-wear additives in combination with detergents, antioxidants and dispersants. Typically, such an additive package will also comprise one or more carrier oils. Said carrier oils may also be esters or may be selected from any of the group of API base oil Groups I to V.

Preferably, said performance additive package is present in an amount in the range of from 9 to 14 wt % based on the overall weight of the lubricating composition.

Typical extreme pressure anti-wear additives include phosphorous- and sulfur-based molecules, providing a level of phosphorus of at least 0.1 wt % and a level of sulfur of at least 1.7 wt % based on the overall lubricating composition.

Further suitable additives may be added to the lubricating composition depending on its specific requirements. These include, but are not limited to corrosion inhibitors, friction modifiers, and pour point depressants.

A preferred friction modifier for use in the present invention is a fatty acid ester with a polyhydric alcohol. Typically, such a friction modifier may be added in an amount in the range of from 0.5 to 3 wt % based on the overall weight of the lubricating composition.

Preferably, the kinematic viscosity measured at 100° C. of the lubricating composition of the present invention is in the range of from 4 to 8 cSt. An advantage of the present invention is that the high viscosity ester components tend to shear down during operation. Under cold starting conditions during races, a thicker lubricants layer is protecting the components from wear, but while racing the lubricant is shearing down to lower viscosity and therefore leads to a higher efficient operation of the transmission unit.

The invention will now be further described with the following, non-limiting, examples.

EXAMPLES

Four transmission fluids were blended according to the amounts set out in Table 1. Comparative Example 1 represents a conventional automatic transmission fluid. Comparative Example 2 represents a typical racing transmission fluid used as a reference. Examples 1 and 2 are inventive examples.

The components used are as follows:

GRP III base oil—a base oil mixture, consisting of base oils according to API (American Petroleum Institute) Group III.

Ester base oil A—a synthetic, biodegradable (OECD Test Guideline 301B) base fluid, with a typical kinematic viscosity at 100° C. of 5 $mm^2/s$ and a typical kinematic viscosity at 40° C. of 22 $mm^2/s$.

Ester base oil B—a synthetic, biodegradable (OECD Test Guideline 301B) and hydrolytically stable monoester with a typical kinematic viscosity at 100° C. of 2.8 $mm^2/s$ and a typical kinematic viscosity at 40° C. of 8.7 $mm^2/s$.

Ester base oil C (viscosity modifier)—high viscosity complex ester with a typical Kinematic Viscosity at 100° C. of 2000 $mm^2/s$ and a typical kinematic Viscosity at 40° C. of 47000 $mm^2/s$ with a biodegradability of <20% (OECD Test Guideline 301B)

Ester base oil D (viscosity modifier)—high viscosity complex ester with a typical Kinematic Viscosity at 100° C. of 2000 $mm^2/s$ and a typical kinematic Viscosity at 40° C. of 40000 $mm^2/s$ Performance additive package A—mixture of gear oil performance additives, suitable for rear axle applications Performance additive package B—mixture of performance additives for automatic transmission fluids, suitable for automatic transmission concepts, incl. clutch systems.

Ester based friction modifier—Fatty acid ester, an ashless friction modifier for gear- and engine oils.

Viscosity modifier—a polymethacrylate, dissolved in mineral oil with a typical kinematic viscosity at 100° C. of 400 $mm^2/s$.

Silicon oil based antifoam—a silicone oil with a typical kinematic viscosity at 100° C. of 12500 $mm^2/s$ or 30000 $mm^2/s$ diluted in solvent, optionally combined with a polyacrylate.

TABLE 1

| Component | | Comp. Example 1 | Comp. Example 2 | Example 1 | Example 2 |
|---|---|---|---|---|---|
| GRP III Base oil | wt % | 88.35 | — | — | — |
| Ester base oil A | wt % | — | 83.175 | 23.00 | 12.5 |
| Ester base oil B | wt % | — | — | 62.7 | 67.95 |
| Ester base oil C (VM function) | wt % | — | — | 0.75 | 6.0 |
| Ester base oil D (VM function) | wt % | — | 5.275 | — | — |
| Performance Additive Package A | wt % | — | 10.5 | 12.5 | 12.5 |
| Performance Additive Package B | wt % | 8.9 | — | — | — |
| Ester based friction modifier | wt % | — | 1 | 1 | 1 |
| Viscosity modifier | wt % | 2.5 | — | — | — |
| Silicon oil based Antifoam | wt % | 0.25 | 0.05 | 0.05 | 0.05 |

The viscometric properties of the base four examples were measured and are set out in Table 2.

TABLE 2

| Test | Method | Comp. Example 1 | Comp. Example 2 | Example 1 | Example 2 |
|---|---|---|---|---|---|
| Kinematic Visc. at 40° C. | ASTM D445/446 | 25.0 cSt | 39.5 cSt | 23.5 cSt | 14.4 cSt |
| Kinematic Visc. at 100° C. | ASTM D445/446 | 5.5 cSt | 8.8 cSt | 6.0 cSt | 4.0 cSt |
| VI | DIN ISO 2909 | 156 | 210 | 221 | 191 |
| KRL Shear: viscosity loss after 20 h (KV100) | DIN 51350-6 | <5% | <5% | 4% | 0.2% |

FZG efficiency testing according to FVA 345 was carried out to underline the results from the actual gearbox. The efficiency screener test (FZG-E-C/0,5:20/5:9/40:120) according to FVA 345 measures friction properties of lubricants on gears and its implication on efficiency. Efficiencies at different conditions (rotational speed 0.5 m/s to 20 m/s; Load stages KS0 to KS9 and temperatures 40° C. to 120° C.) are measured against a reference fluid on a standard FZG test rig. Also, a steady state temperature is measured in order to compare the heat losses and the resulting efficiency losses.

Example 2 was run against Comparative Example 1 and was measured to have an 8.0° C. lower steady state temperature.

This result indicates that in a real electric race drivetrain application the ester base lubricant compositions of the invention would also run at lower operational temperatures and would therefore also result in less heat loss, increasing the efficiency.

The temperature dependence of a number of properties was measured for Comparative Example 2 and Examples 1 and 2 and the results are shown in FIGS. 1 to 4.

FIG. 1 shows a comparison of the kinematic viscosity profile over a range of temperatures for Comparative Example 2, Example 1 and Example 2.

Figure 2:
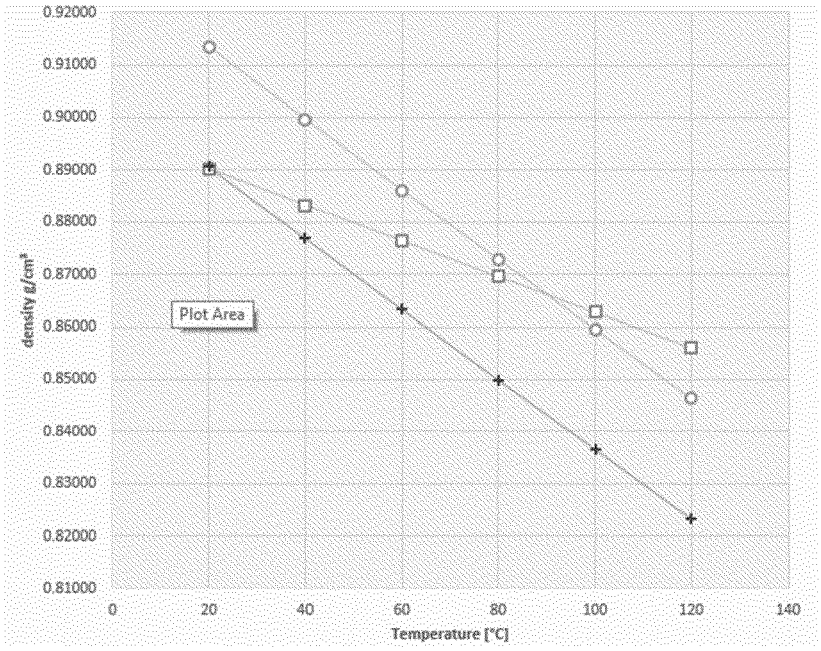

FIG. 2 compares the density over temperature profile of the Examples. Higher content of thickening ester base oils like in the Comparative Example 2 and Example 2 leads to higher density levels over temperature compared to Example 1.

Figure 3:
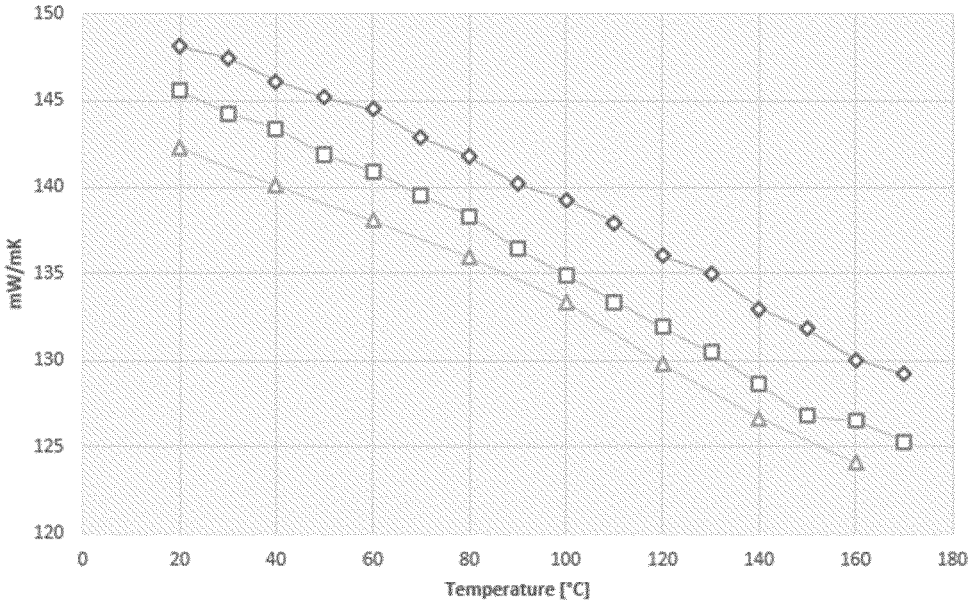
Figure 4:
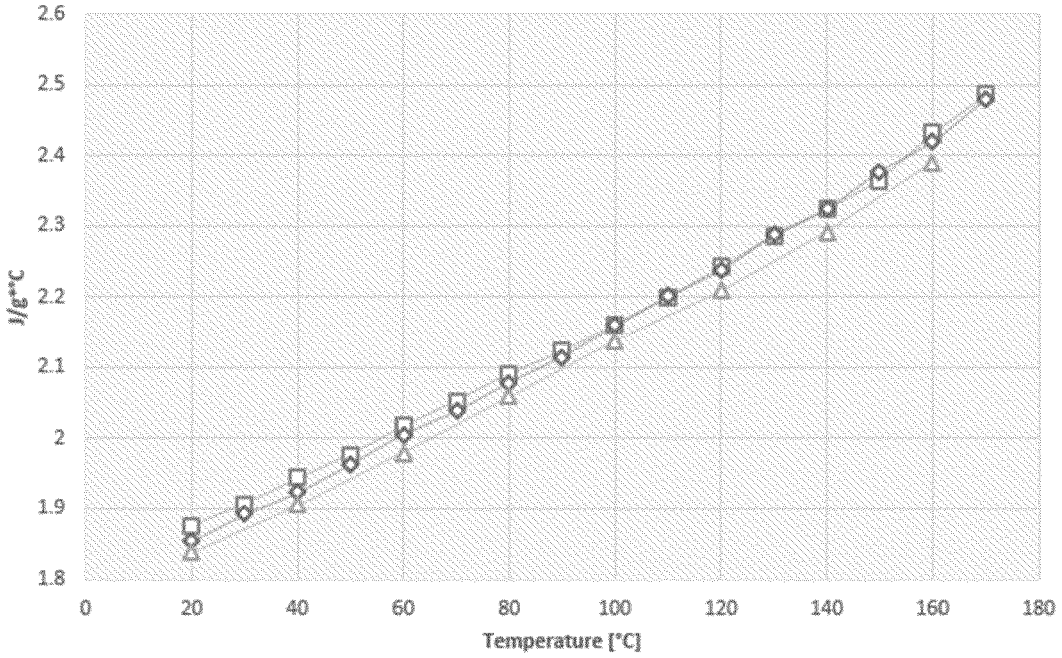

Density and kinematic viscosity profiles, shown in FIGS. 1 and 2, have a direct impact on the thermal conductivity and specific heat capacity of the lubricant formulations FIG. 3 shows the results for thermal conductivity and specific heat capacity has been measured according to a modified ASTM D7896-19 method. To conduct the testing, a Flucon Measuring System Lambda with PSL LabTemp 30190 was used.

Example 1 has the lowest thermal conductivity performance profile due to the lowest density. The higher the density of the formulation, the higher the thermal conductivity.

The viscosity profile and selected components for the formulation have a significant impact on the specific electrical conductivity and resistivity of the transmission fluid. To be compatible with electric motors, a lubricating composition needs to have low conductivity in order to insulate high voltage components from each other and prevent dielectric breakdowns. The fluid impedance and derived measures of specific electrical conductivity and resistivity were measured with a Flucon Epsilon, according to DIN EN 60247.

Figure 5:
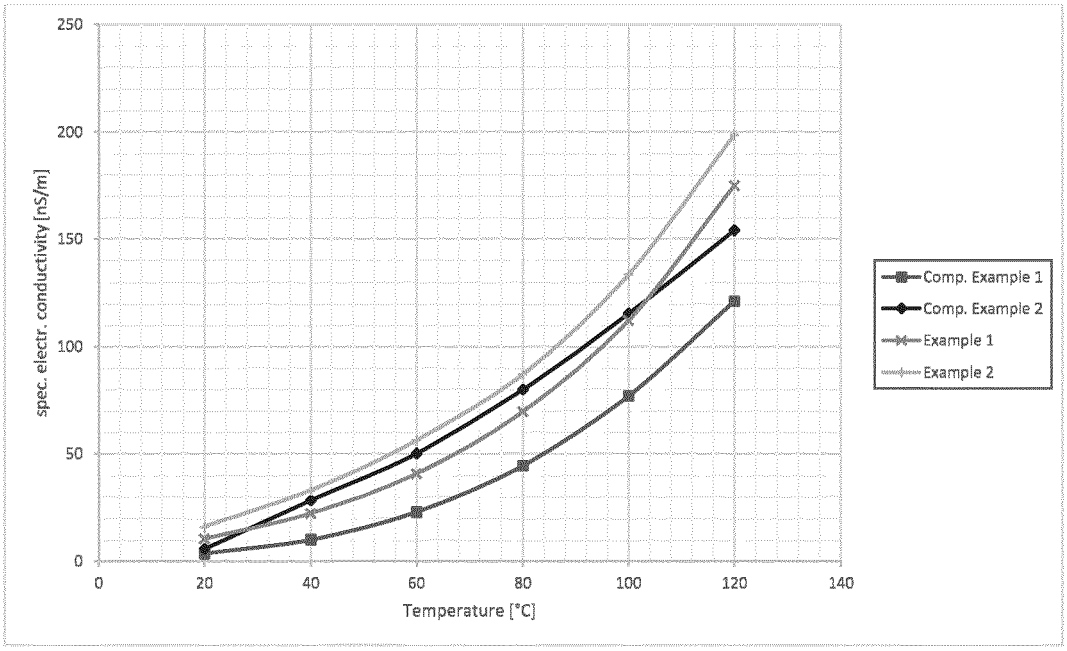
Figure 6:
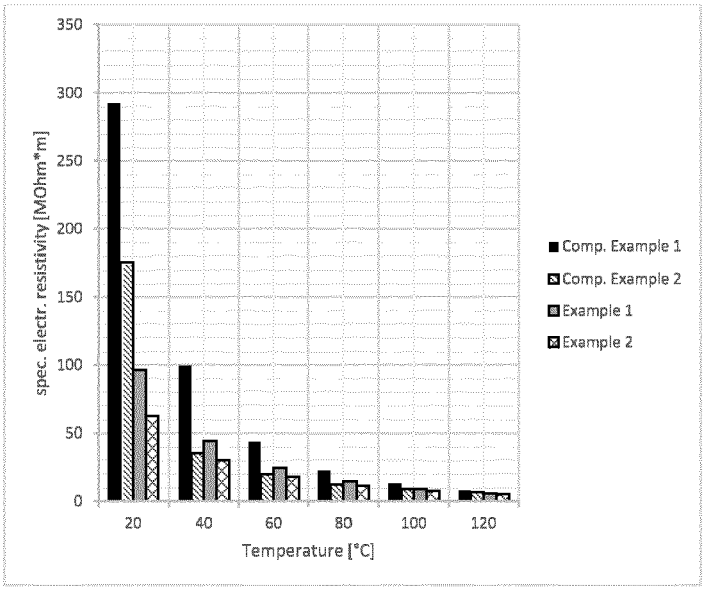

FIG. 5 shows the specific electrical conductivity in nS/m of Example 1 and 2 compared to Comparative Example 1. FIG. 6 shows the specific electrical resistivity in MOhm*m as a consequence of the specific electrical conductivity. Examples 1 and 2 have an electrical resistivity of more than 60 MOhm*m at 20° C. and more than 6 MOhm*m at 100° C. Therefore, the specific electrical resistivity of Example 1 and Example 2 are comparable or higher than those of Comparative Example 2 although they have a much lower viscosity which typically would result in lower specific electrical resistivity or higher specific electrical conductivity at measured temperatures of 20° C. and 100° C.

Efficiency Testing in Formula E Gearbox

Laboratory tests and viscosity profiles have shown differences between the three ester-based formulations (Comparative Example 2, Example 1 and Example 2) in terms of thermal properties. Real benefits of different viscosities were then tested in full application tests. Shell conducted a test matrix in a racing gear box for electric cars.

The Gearbox was installed on a driveline test rig, connected to two brakes and one electric motor to simulate realistic racing conditions. The electric motor is running the gearbox whereas the brakes are used to simulate certain load conditions. To measure a potential change of efficiency during operation, the input torque, generated by the electric motor and output torque at the brakes has been monitored.

Applied test conditions and load profiles were taken out of recorded data from real racing activities and translated to map conditions on the test rig. The gearbox was run at different torque [NM] over speed [1/min] mappings. Comparing the torque over speed mapping between the tested fluids determined any efficiency gains due to the lubricant formulation.

Through low viscosity concepts, highly efficient electric powertrains with efficiency level of >95%, can be further optimized. The Test data shows that with the 4cSt ester-based fluid (Example 2) compared to a typical ester based racing fluids (Comparative Example 1), formulated at 8.8cst, further efficiency gains up to 0.5% can be reached at operating temperature between 60-90° C., applying torque between −100 NM (recuperation) and 100 NM at speeds between 6000 to 24000 l/min.

Comparing Comparative Example 1 and Inventive Example it is shown that the inventive Example still provides increased efficiency in the racing powertrain of up to 0.25%.

We claim:

1. A lubricating composition for use as a transmission fluid in an electric vehicle, said lubricating composition comprising:

(i) at least 70 wt %, based on the overall weight of the lubricating composition, of a biodegradable ester base oil with a kinematic viscosity at 100° C. in the range of from 2.5 to 7.0 $mm^2/s$, wherein the ester is biodegradable according to OECD test guidelines series 301;

(ii) at least 0.5 wt % and no more than 10 wt %, based on the overall weight of the lubricating composition, of a viscosity index improver which is at least one high viscosity ester base oil with a kinematic viscosity at 100° C. of at least 1000 $mm^2/s$; and (iii) an anti-foam additive selected from silicone oil based antifoam additives and polyacrylate antifoam additives.

2. A lubricating composition as claimed in claim 1, wherein said lubricating composition has a specific electrical resistivity according to DIN EN 60247 of more than 60 MOhm*m at 20° C. and more than 6 MOhm*m at 100° C.

3. A lubricating composition as claimed in claim 1, wherein the biodegradable ester base oil is a blend of two or more types of biodegradable ester base oils.

4. A lubricating composition as claimed in claim 3, wherein the biodegradable ester base oil is made up of a mixture of two ester base oils and comprises a first biodegradable ester base oil with a kinematic viscosity at 100° C. in the range of from 4 to 6 $mm^2/s$ and a second biodegradable ester base oil with a kinematic viscosity at 100° C. in the range of from 2.5 to 3 $mm^2/s$.

5. A lubricating composition as claimed in claim 4, wherein the first biodegradable ester base oil is present in an amount in the range of from 15 to 30 wt % based on the overall lubricating composition and the second biodegradable ester base oil is present in an amount in the range of from 50 to 70 wt % based on the overall lubricating composition.

6. A lubricating composition as claimed in claim 1, wherein the viscosity index improver which is at least one high viscosity ester base oil has a kinematic viscosity at 100° C. of at least 1500 $mm^2/s$.

7. A lubricating composition as claimed in claim 1, the anti-foam additive is a silicone oil based antifoam additives and is present in an amount such that the silicon content of the overall lubricating composition is in the range of from 2 to 15 ppmw.

8. A lubricating composition as claimed in claim 1, wherein the lubricating composition also comprises a performance additive package comprising at least one or more extreme pressure anti-wear additives in combination with detergents, antioxidants and dispersants.

9. A process for lubricating an electric vehicle drive train comprising a transmission, said process comprising the steps of applying to said transmission a lubricating composition, said lubricating composition comprising:

(i) at least 70 wt %, based on the overall weight of the lubricating composition, of a biodegradable ester base oil with a kinematic viscosity at 100° C. in the range of from 2.5 to 7.0 $mm^2/s$ wherein the ester is biodegradable according to OECD test guidelines series 301;

(ii) at least 0.5 wt % and no more than 10 wt %, based on the overall weight of the lubricating composition, of a viscosity index improver which is at least one high viscosity ester base oil with a kinematic viscosity at 100° C. of at least 1000 $mm^2/s$; and (iii) an anti-foam additive selected from silicone oil based antifoam additives and polyacrylate antifoam additives.

* * * * *